United States Patent [19]

Warshawsky

[11] Patent Number: 4,473,874

[45] Date of Patent: Sep. 25, 1984

[54] LAMP SWING UNIT

[76] Inventor: Jerome Warshawsky, 3284 Bertha Dr., Baldwin Harbor, N.Y. 11510

[21] Appl. No.: 434,546

[22] Filed: Oct. 15, 1982

[51] Int. Cl.[3] ..... F21M 3/18

[52] U.S. Cl. ..... 362/427; 362/417; 362/430; 362/431; 362/432; 248/284

[58] Field of Search ..... 362/432, 431, 427, 417, 362/413, 430; 248/284

[56] References Cited

U.S. PATENT DOCUMENTS

| | | | |
|---|---|---|---|
| 2,280,402 | 4/1942 | Greppin | 362/432 |
| 2,488,898 | 11/1949 | Brasty | 362/413 |
| 3,983,386 | 9/1976 | Schallenkammer | 362/427 |
| 4,247,886 | 1/1981 | Warshawsky | 362/431 |
| 4,347,557 | 8/1982 | Warshawsky | 362/431 |

*Primary Examiner*—Stephen J. Lechert, Jr.
*Assistant Examiner*—Howard J. Locker
*Attorney, Agent, or Firm*—Stephen E. Feldman

[57] ABSTRACT

The swing unit, for mounting the swing arm assembly of a swing arm lamp, is formed as a relatively short substantially tubular member having a truncated hemispherical top and a tubular mounting end of reduced outside diameter and that is provided with a circumferential groove. The reduced end of the swing unit is received by the mounting seat of a support unit which mounts same for rotation about a predetermined axis of rotation. A threaded bolt like member is carried by the support unit so that an end of the threaded member can be moved from a position with its end projecting into the groove, to prevent unseating of the swing unit from the support, but not so as to prevent rotation thereon; to a position with its end removed from the groove so that the swing unit can be removed from the support. A threaded opening in the truncated section of the top receives the threaded end of a tubular swing arm of the swing arm assembly along a line which is at an angle of 45° to said predetermined axis of rotation. The support for the swing unit is either plate like for mounting to a wall, or substantially tubular to facilitate mounting the swing arm to a base mounted support post for a table or floor lamp. The support mounts either a single swing unit for a single swing arm assembly; or a pair of co-axial swing units for a pair of co-planar swing arms of either straight or bowed configuration.

24 Claims, 12 Drawing Figures

FIG. 5
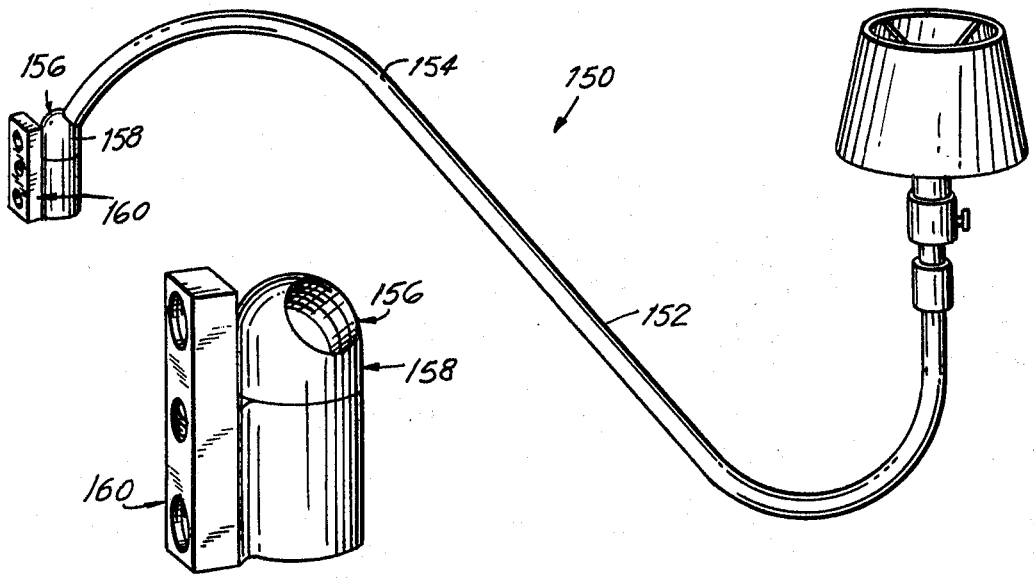
FIG. 6
FIG. 7
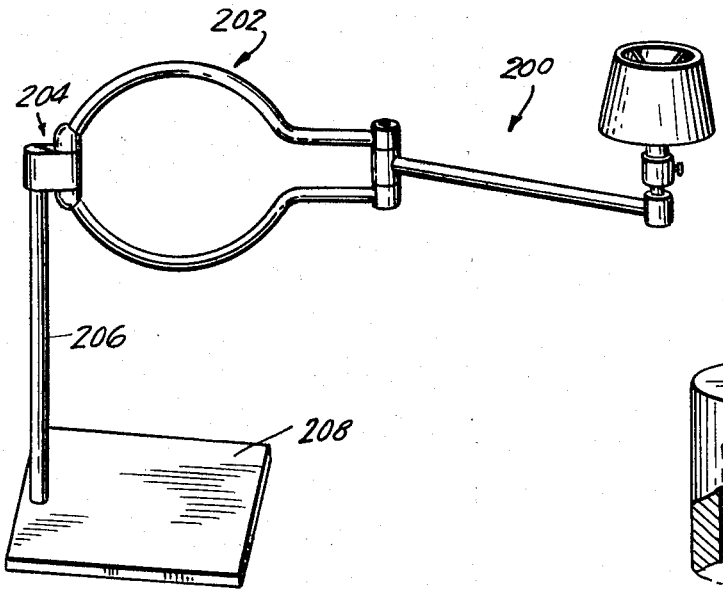
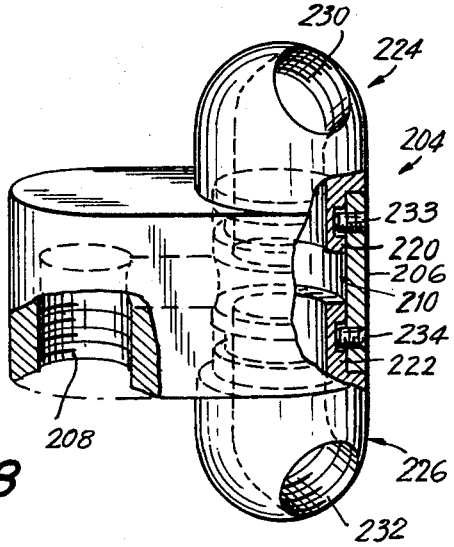
FIG. 8

FIG. 9
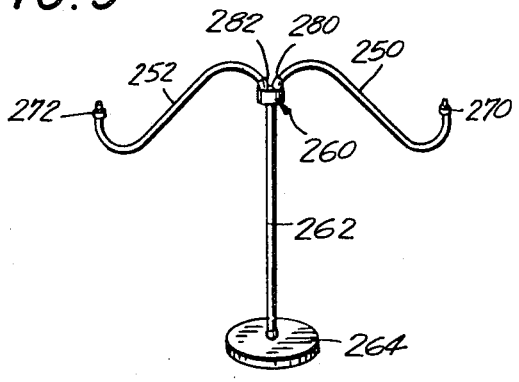
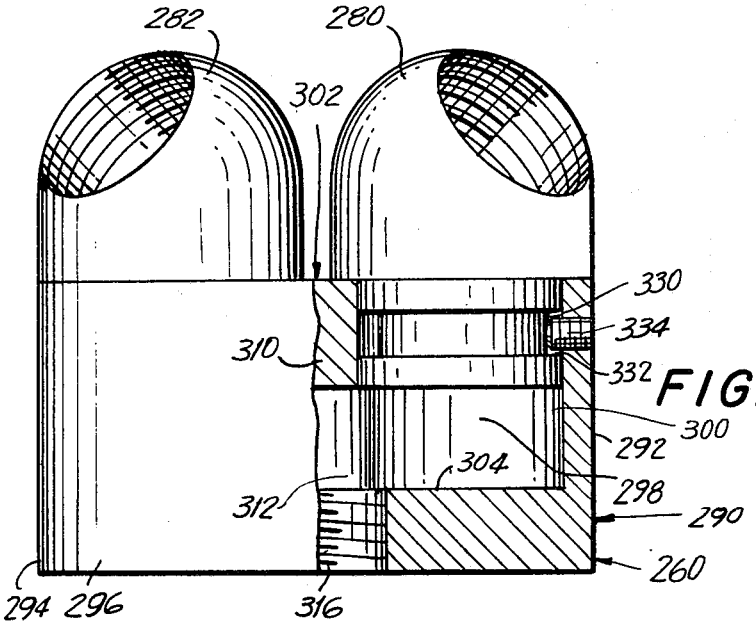
FIG. 10
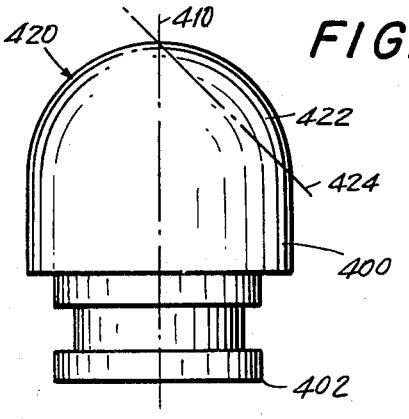
FIG. 11
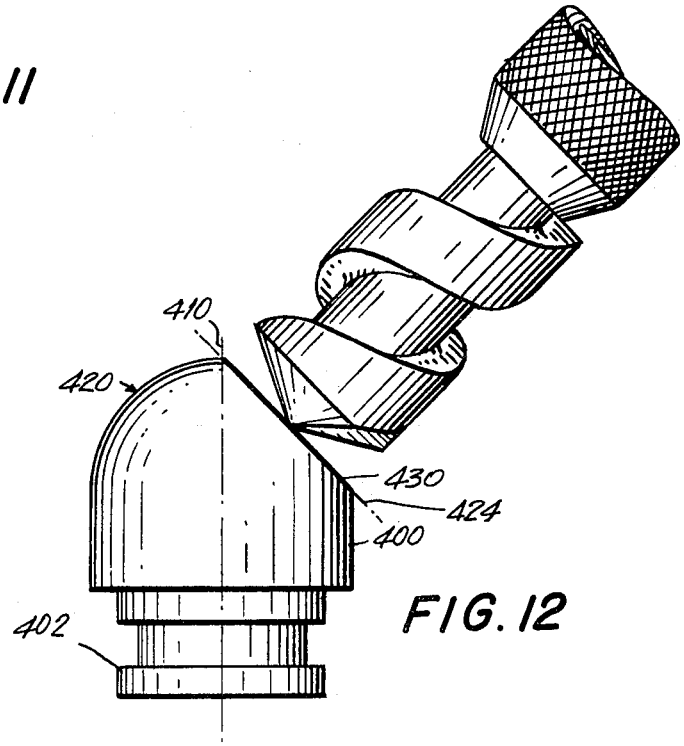
FIG. 12

LAMP SWING UNIT

BACKGROUND OF THE INVENTION

1. Field of Application

This invention relates to swing arm lamps; and more particularly to swing units and swing unit swing arm assemblies for swing arm lamps.

2. Description of the Prior Art

Lamps and lighting units are important and necessary if there is to be adequate light in a room or office, or to illuminate a work area, chair, sofa or similar environment. But while the basic function of a lamp or lighting unit is to provide proper illumination it seems that many require that it must also do so utilizing functional elements that are aesthetically pleasing, and that are arranged in an aesthetically pleasing combination.

Swing arm lamps find use where it is desired, or necessary, to have a light source that can be moved to various positions without having to move the lamp base or mounting member. This is done to selectively illuminate various portions of a large area wherein it is not necessary to illuminate the entire area at once; especially when doing so would require unwarranted expenditures for extra electricity, and most likely for the lighting equipment required to light up the entire area.

Some swing arm lamps mount the swing arm assembly to the swing unit so that the swing arm assembly extends out from the swing unit at a right angle with respect to the axis of rotation of the swing unit. Some other swing arm lamps connect the end of the swing arm assembly to the swing unit so that a portion of the swing arm assembly is co-axial with the axis of rotation of the swing unit. However functional these swing arm lamps may be they seem to have failed to satisfy the need for an aestheric appearance coupled with an effective performance of the lighting function. Attempts to enhance the aesthetic appearance of swing arm lamps by disposing the swing arm assembly at an angle, other than a right angle, with respect to the swing arm axis of rotation have not proved fruitful. In many such instances the appearance of that portion of the swing unit, to which the swing arm must be connected, as prepared for an angular connection to the swing arm renders the entire lamp unacceptable.

SUMMARY OF THE INVENTION

It is therefore an object of this invention to provide a novel and improved swing unit for a lamp.

It is another object of this invention to provide a novel and improved swing arm lamp.

It is yet another object of this invention to provide a novel and improved swing arm assembly and swing unit combination for a swing arm lamp.

It is still another object of this invention to provide a novel and improved swing unit, for a swing arm lamp, that mounts the swing arm assembly at an angle to the swing axis of rotation.

It is yet still another object of this invention to provide a novel and improved method of fabricating a swing unit for a swing arm lamp.

It is a further object of this invention to provide a novel and improved method of fabricating a swing unit for a lamp so that the swing unit is attachable to the lamp swing arm assembly at an angle, other than a right angle, to the axis of rotation of the swing unit.

This invention involves swing units for swing arm lamps: and contemplates forming the swing unit with a hemispherical top portion truncated along an imaginary plane disposed at an angle with respect to the angle of the axis of rotation of the swing unit, and providing a connection for a swing arm at said truncated portion of the swing unit so that the swing arm is disposed at an angle, other than a right angle, with respect to the angle of the axis of rotation of the swing unit.

Other objects, features, and advantages of the invention in its details of construction and arrangement of parts will be seen from the above, from the following description of the preferred embodiment when considered with the drawings and from the appended claims.

BRIEF DESCRIPTION OF THE DRAWING

In the drawing:

FIG. 5 is a perspective view of a modified form of wall mounted swing arm support unit for the swing arm of a swing arm lamp, and which incorporates the instant invention;

FIG. 6 is an enlarged perspective view of the swing arm support unit of FIG. 5;

FIG. 7 is a schematic perspective view of a base mounted swing arm lamp utilizing a modified form of swing arm support unit and swing arm assembly;

FIG. 8 is a perspective view of the swing arm support unit for the swing arm lamp of FIG. 7;

FIG. 9 is a perspective view of yet another modified form of base mounted swing arm support unit for a swing arm for a swing arm lamp, and which incorporates the instant invention;

FIG. 10 is a perspective view of the swing arm support unit for the swing arm lamp of FIG. 9;

FIG. 11 is a perspective view of a swing unit during its manufacturing process; and FIG. 12 is a perspective view of the swing unit of FIG. 11 at a further step in its manufacturing process.

DESCRIPTION OF THE PREFERRED EMBODIMENT

Figure 1:
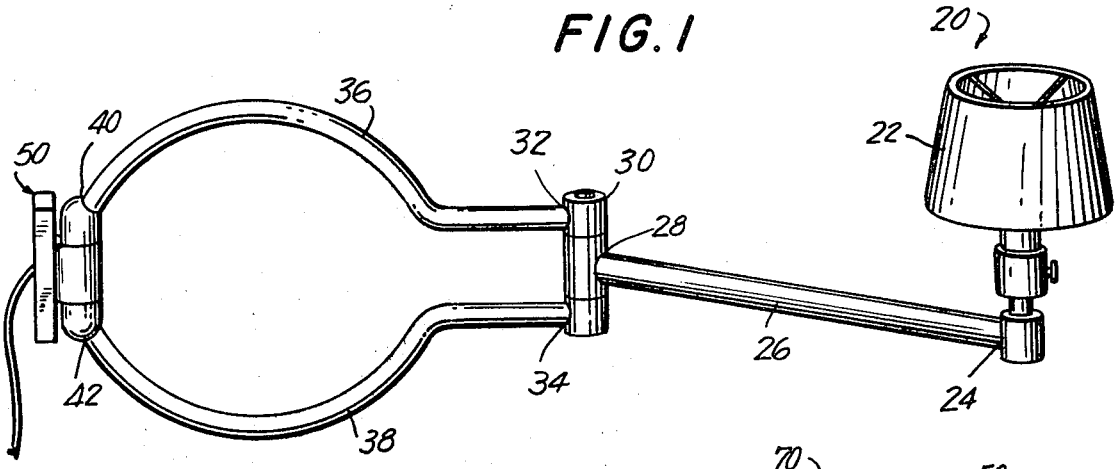
FIG. 1 is a perspective view of a wall mounted swing arm lamp incorporating the instant invention.

With reference to FIG. 1, there is generally shown at 20 a swing arm lamp having a light source 22 carried at a first end 24 of an outboard swing arm 26, the second end 28 of which is connected to and extends from a swivel assembly 30. Swivel assembly 30 is otherwise carried by first ends 32, 34 of inboard swing arms 36, 38 the second ends 40, 42 of which are respectively connected to and extend from a swing arm support unit 50 adapted to be secured to a wall or other vertically disposed member (not shown). Swing arms 26, 36, and 38 are fabricated from tubular material such as pipe, and together with swivel assembly 30 constitutes a swing arm assembly.

Outboard swing arm 26 has external threads (not shown) formed at its ends 24, 28; and is connected to light source 22, and swivel assembly 30, by having such external threads threaded into internal threads (not shown) formed in appropriate openings of light source 22 and swivel assembly 30. Inboard swing arms 36, 38 have external threads (not shown) formed at their respective ends 32, 40 and 34, 42; and are connected to swivel assembly 30. The same procedure is followed to connect ends 40, 42 of inboard swing arms to swing arm support unit 50.

Light source 22 includes a socket 60, for receiving a suitable light bulb, and a shade 62 appropriately and conventionally mounted thereon. Suitable electrical conductor wire 64 extends from socket 60 through outboard swing arm 26, an opening (not shown) suitably formed in swivel assembly 30, through either inboard arm 36 or 38 and out through swing arm support unit 50 as will be hereinafter explained. An appropriate male plug is provided at the end of conductor 64 to connect same, and light source 22 to a source of electricity. A switch 66 is provided on socket 60 to turn same on and off, and through intermediate positions if provided. Conductor 64 can also be connected directly to a junction box, and controlled by a remote switch if desired.

Swing arm support unit 50 (FIGS. 2 and 3) includes a support bracket 70 having a centrally disposed cylindrical support tube 72 formed integral therewith. A pair of mounting openings 74, 76 (FIG. 3), formed into a back wall 78 of bracket 70, are internally threaded to receive suitable threaded members (not shown) for the purpose of mounting bracket 70, swing arm support unit 50, swing arms 36, 38 and 26 and light source 22 to a wall or other suitable vertically disposed member.

A centrally disposed opening 80 extends through bracket 70 and into an opening 81 within support tube 72 to provide a passageway for conductor 64. Two additional openings 82, 84 extend through bracket 70 and into opening 81. Openings 82, 84 are enlarged proximate back wall 78 of bracket 70 and are threaded through the remainder of their lengths sufficient to permit ends 90, 92 respectively of threaded member 86, 88 to extend into opening 81 for purposes to be hereinafter explained.

A pair of swing units 100 (FIGS. 2–4) and 102 (FIGS. 2 and 3) seat upon and are supported by the respective end surfaces of support tube 72 of support bracket 70 and the inner surfaces proximate the upper ends of support tube 72. Swing unit 100 is disposed on top of cylindrical support 72, and swing unit 102 is disposed below cylindrical support 72. The outside diameter of swing units 100, 102 are substantially the same diameter as that of cylindrical support 72; however swing units 100, 102 have walls 104 (FIG. 3) 106 that are respectively thicker than wall 108 of cylindrical of cylindrical support 72. Ends 110, 112 of swing units 100, 102 are each formed with a diameter reduced in size when compared to that of the rest of swing units 100, 102.

Figure 3:
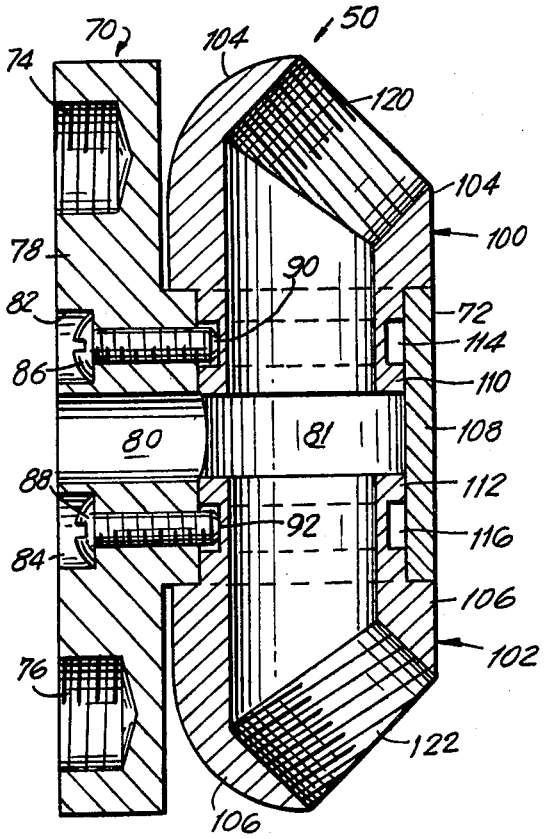
FIG. 3 is an enlarged sectional elevational view of the swing arm support unit of FIG. 2.
Figure 4:
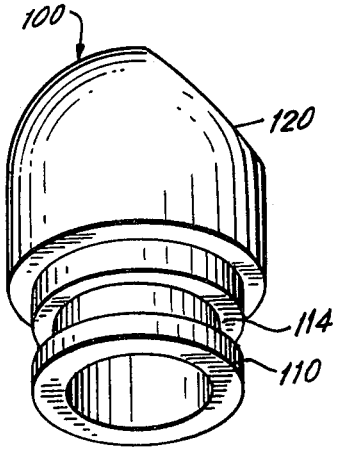
FIG. 4 is a perspective view of the swing unit of the swing arm support unit of FIGS. 2 and 3.

Circumferential circular grooves 114, 116 are respectively formed circumferentially around the surfaces of reduced ends 110, 112 of swing units 100, 102. Grooves 114, 116 are disposed and sized to receive ends 90, 92 respectively of threaded member 86, 88 when threaded members 86, 88 are fully extended and after swing units 100, 102 are positioned on the swing unit mounting eats formed by the cylindrical support 72 (as shown in FIG. 3). Internally threaded swing arm receiving openings 120, 122 are formed respectively in swing units 100, 102 to receive threaded ends 40, 42 of swing arms 36, 38 respectively. It should be noted that an axis co-axial with a center line passing through openings 120, 122 is disposed at an angle with respect to the axis of rotation of swing units 100, 102 upon support 70. In this instance the angle that the center line of openings 120, 122 will meet the axis of rotation at is 45°. The method of so forming openings 120, 122 will be hereinafter described.

To assemble swing arm support unit 50 one need only place swing units 100, 102 with their ends 110, 112 extending respectively into opening 81 of cylindrical support 72 of bracket 70 and so as to seat on the end surface of support 72. Threaded members 86, 88 are thereafter threaded into place so that their respective ends 90, 92 extend into grooves 114, 116 respectively of swing units 100, 102.

Swing arm support unit 50 may thereafter have inboard swing arms 36, 38 threaded into swing units 100, 102 if such has not been accomplished prior to installing swing units 100, 102 on support bracket 70. In similar manner swivel assembly 30, swing arm 26 and light source 22 may thereafter be connected to swing arms 36, 38; or that may be accomplished before swing arms 36, 38 are attached to swing arm support unit 50. The fully assembled swing arm lamp 20 may thereafter be secured to a wall or other vertical support by utilizing appropriately threaded members screwed into threaded openings 74, 76 of bracket 70.

The fully assembled swing arm lamp 20 can be rotated about an axis of rotation passing through cylindrical support 72 and swing units 100, 102 because ends 90, 92 of threaded members 86, 88 will permit rotation of swing units 100, 102 but not removal thereof from swing arm support unit 50.

In FIG. 5 there is shown a swing arm lamp 150 with a swing arm assembly 152 that has only one swing arm 154 connected to and extending from a swing arm support unit 156 (FIGS. 5 and 6). Swing arm support unit 156 utilizes but a single swing unit 158 disposed upon and secured to a support bracket 160. Swing unit 158 is identical to swing unit 100 (FIGS. 3 and 4) and support bracket 160 provides a seat therefore which, in section would appear substantially similar to support bracket 70 of FIG. 3 if cut off just below cylindrical support 72. The lower threaded member 84 (FIG. 3) would not be required for support bracket 160 (FIG. 6) but an opening for conductor wire is provided with internal threads to also facilitate attachment of bracket 160 to a wall or other support member. The lower extremity of the cylindrical support portion of bracket 160 may be closed or it may be open and plugged.

In FIG. 7 there is shown a lamp support 200 with a swing arm assembly 202 identical to the swing arm assembly of FIG. 1. Swing arm assembly 202 is, however, connected to and carried by a swing arm support unit 204 (FIGS. 7 and 8) that facilitates mounting of swing arm assembly 202 upon a support post 206 and base 208. Depending upon the size and proportions of post 206 and base 208 lamp support 200 may support a lamp upon a floor or upon a table, dresser, or desk.

Swing arm support unit 204 includes a support 206 (FIG. 8) with a first opening 208 having internal threads formed therein to receive external threads (not shown) formed on top of support post 206. A through opening 210 is formed in support 206 to receive ends 220, 222 respectively of swing units 224, 226. Swing units 224, 226 are identical to swing units 100, 102 of the embodiment of FIGS. 1–4, and include threaded openings 230, 232 to receive the swing arms of swing arm assembly 202, and appropriately formed grooves to receive ends of threaded members 232, 234 to retain swing units 224, 226 in position, once seated in the swing unit mounting seats formed therefore in support 210, in the manner that threaded members 86, 88 retain swing units 100, 102 on bracket 70.

In FIG. 9 there is shown a pair of swing arms 250, 252 mounted to a vertical swing bracket 260 that is, in turn, disposed on top of a support post 262 which is connected to and extends up from a support base 264. The free ends 270, 272, respectively, of swing arms 250, 252 are fitted with swivel units of conventional construction and adapted to receive suitable light units (not shown). Swing arms 250, 252 are formed of tubular stock and into the curved configuration shown. Any other suitable curved configuration can be utilized.

The other ends of swing arms 250, 252 are connected to swing units 280, 282 (FIGS. 9 and 10) carried by vertical swing bracket 260.

Vertical swing bracket 260 (FIGS. 9 and 10) includes a support body 290 of somewhat oval configuration with round semi-circular ends 292, 294 and parallel flat sides 296, 298. A pair of circular openings 300 (only one shown) are formed in the body 290 extending down from an upper surface 302 thereof and terminating at a lower wall 304 of body 290. A central wall 310, separating openings 300, terminates short of lower wall 304 to provide a passageway 312 for conductor wire. A bottom opening 316 extending from passageway 312 out through lower wall 304, is provided with internal threads to receive the external threads that are formed on the upper end of support post 262.

Figure 2:
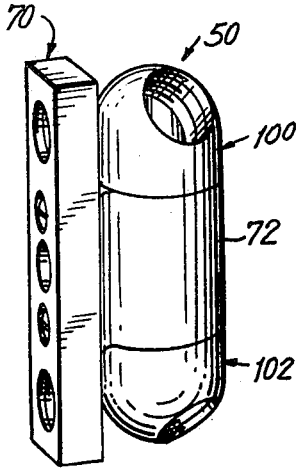
FIG. 2 is an enlarged perspective view of the swing arm.

Upper surface 302 of body 290 as it surrounds openings 300 forms, with the upper inner walls of openings 300, mounting seats for swing units 280, 282 (FIGS. 2 and 3). Swing units 280, 282 are identical with swing units 100, 102 as shown in FIGS. 2 and 3. They each include a reduced seating portion 330 with a circumferential groove 332 that receives the end of a threaded member 334 carried by body 290. When threaded members 334 are fully inserted into body 290 their ends enter groove 332 and prevent removal of swing units 280, 282 from vertical bracket 260. If threaded members are turned so that their ends do not project into grooves 332, then swing units 280, 282 may be removed from bracket 260. The cooperation of swing units 280, 282 with bracket 260 is the same as the cooperation of swing unit 100 (FIG. 3) with support 70.

Swing units 100, 102, 158, 230, 232, 280, and 282 are all identical and formed from a member whose lower half 400 (FIGS. 11 and 12) is tubular (i.e. it is substantially cylindrical in configuration with a cylindrical opening from its lower wall 402 extending up into the unit for a predetermined distance. The inner and outer walls being parallel with each other about a predetermined axis of rotation 410 extending vertically through the swing unit).

The upper portion 420 of the swing units are initially formed into hemispheres by any suitable and conventional equipment and process. Thereafter a segment 422 (FIG. 11) of each swing unit is planed off or otherwise cut off along an imaginary plane 424 disposed at a predetermined angle with respect to axis of rotation 410. In this instance the selected predetermined angle is 45°; it may however be any other suitable and appropriate angle.

After segment 422 has been removed from the swing unit the swing arm receiving opening is drilled into a surface 430 remaining after segment 422 is removed. The drilled hole is thereafter threaded to receive the threaded end of a swing arm. The drilling and threading are accomplished by conventional equipment and processes. The swing units may be so formed one by one by hand or continuously in an automated process. The final swing unit displays an extremely functional and aesthetically pleasing appearance.

From the above description it will thus be seen that there has been provided novel and improved swing arm lamps, and novel and improved swing units which mount the swing arm assemblies therefore at an angle with respect to the axis of rotation of the swing arms.

It is my understanding that although I have shown the preferred form of my invention that various modifications may be made in the details thereof without departing from the spirit as comprehended by the following claims.

In addition, it thus will be seen that there is provided a lamp swing unit which achieves the various objects of the invention, and which is well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention.

I claim:

1. A swing arm assembly for a lamp; comprising:

(a) swing arm means for supporting a light source for rotation about a predetermined axis of rotation;

(b) swing unit means connected to said swing arm means so that a center line through an end portion of said swing arm means, that connects to said swing unit means, intersects said predetermined axis of rotation, and does so at a predetermined angle other than 90° to said predetermined axis of rotation;

(c) said swing unit means including a swing unit mounting portion substantially cylindrical in external configuration; and (d) support means coacting with said swing unit means to mount same for rotation about said predetermined axis of rotation;

(e) said support means including at least one swing unit mounting seat sized and arranged to receive said swing unit mounting portion and to facilitate rotation of said swing unit means about said predetermined axis of rotation.

2. The swing arm assembly of claim 1: wherein said predetermined angle at which said swing unit mounts said end portion of said swing arm means is 45°.

3. The swing arm assembly of claim 1 wherein said swing unit means mounts said end portion of said swing arm assembly at a mounting portion of said swing unit means, which mounting portion is substantially hemispherical in external configuration and includes a swing arm mounting area which is formed by truncating said hemispherical mounting portion along an imaginary plane that intersects said axis of rotation along said predetermined angle.

4. The swing arm assembly of claim 3: wherein said predetermined angle is 45°.

5. The swing arm assembly of claim 4; wherein:

(a) said mounting portion of said swing unit means further includes a circular groove formed in its external cylindrical surface; and (b) said support means includes retention means movable between a position wherein a portion of said retention means extends into said circular groove of said swing unit means and prevents movement of said swing unit means along said predetermined axis of rotation while not hindering rotation thereof about said predetermined axis of rotation, and a position removed from said circular groove to permit movement of said swing unit means in a direction along said predetermined axis of rotation.

6. The swing arm assembly of claim 5; wherein:

(a) said swing unit means includes a pair of swing units, each swing unit including a swing unit mounting portion substantially cylindrical in external configuration with a circular groove formed in the surface thereof; and (b) said support means includes a pair of swing unit mounting seats spaced one from the other but aligned so that there is but one predetermined axis of rotation for both of said swing units, and a pair of said retention means one disposed for coaction with each of said circular grooves;

(c) said swing arm means includes a pair of swing arms; and (d) said swing units each being connected to one of said swing arms and mounting same in a co-planar arrangement.

7. The swing arm assembly of claim 6: wherein each of said swing units is substantially tubular in configuration.

8. The swing arm assembly of claim 7: wherein each swing arm is substantially tubular in configuration and said end portion thereof is connected to its respective swing unit at said predetermined angle.

9. The swing arm assembly of claim 8: wherein each swing arm is formed into an arcuate configuration.

10. The swing arm assembly of claim 9: wherein said swing arm assembly mounting means of said support means comprises a substantially rectangular plate, and said swing unit mounting seat of said support means is substantially tubular in configuration extending out from said plate so that the tubular opening of said mounting seat is spaced from and extends parallel to a surface of said plate and has an axis that is co-axial with said predetermined axis of rotation.

11. The swing arm assembly of claim 10 wherein one end of said plate and one end of said tubular mounting seat terminate in a predetermined imaginary plane and said tubular mounting seat is closed at said one end.

12. The swing arm assembly of claim 10: wherein said plate extends a predetermined distance beyond each end of said tubular mounting seat and said mounting seat mounts a swing unit at each of its ends.

13. The swing arm assembly of claim 9: wherein said swing arm assembly mounting means is plate like in configuration and facilitates mounting the swing arm assembly to a wall or flat surface.

14. The swing arm assembly of claim 9: wherein said swing arm assembly mounting means is substantially tubular in configuration and serves to mount the swing arm assembly on top of a tubular support.

15. The swing arm assemblies of claim 9: wherein said swing arm assembly mounting means is substantially an oval in cross-sectional configuration and mounts a pair of swing units one of said swing units being mounted for rotation about a first predetermined axis of rotation and the other of said swing units being mounted for rotation about a second axis of rotation, said first and said second axes of rotation being spaced and parallel to each other.

16. A swing arm support unit for a swing arm lamp; comprising:

(a) swing unit means for mounting a swing arm assembly for rotation about a predetermined axis of rotation;

(b) said swing unit means including a swing arm mounting portion that is substantially hemispherical in external configuration and includes a swing arm mounting area which is formed by truncating said hemispherical mounting portion along an imaginary plane that intersects said axis of rotation at a predetermined angle;

(c) said swing unit further including a swing unit mounting portion; and (d) support means coacting with said swing unit to mount same for rotation about said predetermined axis of rotation;

(e) said support means including mounting means to facilitate mounting said support means, and any light source to be supported thereby.

17. The swing arm support unit of claim 16; wherein:

(a) said swing unit means mounting portion is substantially cylindrical in external configuration;

(b) said support means includes at least one swing unit mounting seat sized and arranged to receive said swing unit mounting portion and to facilitate rotation of said swing unit means about said predetermined axis of rotation;

(c) said mounting portion of said swing unit means further including a circular groove formed in its external cylindrical surface; and (d) said support means including retention means movable between a position wherein a portion of said retention means extends into said circular groove of said swing unit means and prevents movement of said swing unit means along said predetermined axis of rotation while not hindering rotation thereof about said predetermined axis of rotation, and a position removed from said circular groove to permit movement of said swing unit means in a direction along said predetermined axis of rotation.

18. The swing arm support unit of claim 17; wherein:

(a) said swing unit means includes a pair of swing units, each including a swing unit mounting portion substantially cylindrical in external configuration with a circular groove formed in the surface thereof; and (b) said support means includes a pair of swing unit mounting seats spaced one from the other but aligned so that there is but one predetermined axis of rotation for both of said swing units, and a pair of said retention means one disposed for coaction with each of said circular grooves.

19. The swing arm support unit of claim 18: wherein said mounting portion of each of said swing units is substantially tubular in configuration.

20. The swing arm support unit of claim 19: wherein said support unit mounting means comprises a substantially rectangular plate, and said swing unit mounting seat of said support means is substantially tubular in configuration extending out from said plate so that the tubular opening of said mounting seat is spaced from and extends parallel to a surface of said plate and has an axis that is co-axial with said predetermined axis of rotation.

21. The swing arm support unit of claim 20: wherein one end of said plate and one end of said tubular mounting seat terminate in a predetermined imaginary plane and said tubular mounting seat is closed at said one end.

22. The swing arm support unit of claim 20: wherein said plate extends a predetermined distance beyond each end of said tubular mounting seat and said mounting seat mounts a swing unit at each of its ends.

23. The swing arm support unit of claim 19: wherein said support unit mounting means is plate like in configuration and facilitates mounting a swing arm assembly to a wall or flat surface.

24. The swing arm support unit of claim 19: wherein said support unit mounting means is substantially tubular in configuration and serves to mount a swing arm assembly on top of a tubular support.

* * * * *